United States Patent [19]

Colbert

[11] 4,145,975

[45] Mar. 27, 1979

[54] PALLET CONSTRUCTION

[76] Inventor: Douglas W. Colbert, 29 Moore SW., Ardmore, Okla. 73401

[21] Appl. No.: 861,057

[22] Filed: Dec. 15, 1977

[51] Int. Cl.[2] ..... B65D 19/32

[52] U.S. Cl. ..... 108/52.1; 108/901

[58] Field of Search ..... 108/51.1, 51.3, 52.1, 108/53.1, 53.3, 55.1, 55.3, 55.5, 56.1, 57.1, 901; 248/346; 206/386, 595–600; 217/43 A

[56] References Cited

U.S. PATENT DOCUMENTS

| | | | |
|---|---|---|---|
| 2,544,743 | 3/1951 | Vrabcak | 108/52.1 X |
| 2,709,559 | 5/1955 | Geisler | 108/51.3 |
| 2,928,638 | 3/1960 | Parker | 108/51.3 |
| 3,946,883 | 3/1976 | Beal | 108/51.3 X |

FOREIGN PATENT DOCUMENTS

| | | | |
|---|---|---|---|
| 291343 | 6/1965 | Netherlands | 108/52.1 |

*Primary Examiner*—Roy D. Frazier
*Assistant Examiner*—William E. Lyddane
*Attorney, Agent, or Firm*—Robert K. Rhea

[57] ABSTRACT

In a load bearing three-way pallet fabricated in a flat substantially square configuration, a transversely disposed open frame forms a central load bearing support which is transversely bridged by an overlying sheet. The sheet is preformed to present a raised load bearing surface having transverse upwardly open channels on opposing sides of the frame for the reception of liftfork fingers and lifting a load off the pallet. Each end portion of the sheet receives liftfork fingers thereunder and spaced-apart transverse slots formed in the channel walls normal to the longitudinal axis of the channels receive liftfork fingers from another direction for lifting the pallet with a load thereon.

1 Claim, 3 Drawing Figures

PALLET CONSTRUCTION

BACKGROUND OF THE INVENTION

1. Field of the Invention

The present invention relates to cargo handling and storage apparatus and more particularly to pallets for supporting loads moved by liftforks.

Pallets have come into wide spread use in industry for storage and shipping of goods, the goods generally being confined by containers, such as boxes or in bundles where the nature of the goods permits. It is usual practice to stack a selected quantity of the goods on a pallet capable of receiving the steel fingers of a forklift to move the pallet and goods from one location to another either in a warehouse or depositing them on the bed of the vehicle.

2. Description of the Prior Art

Pallets, as conventionally used, generally comprise a wooden panel or spaced slats overlying and secured to a plurality of wooden rails. Such wooden pallets have the disadvantage, by repeated use, of being subject to splintering or cracking. A further disadvantage being the mass of the pallet and its cost of construction.

U.S. Pat. No. 3,126,843 is an example of the above described pallet formed from wood and plastic material which utilizes an adhesive for joining the components which reduces the cost of construction, such as the nailing of wooden slats and for reducing the mass of the pallet.

A one-time use, lightweight, easily assembled supply of components of a pallet is disclosed by U.S. Pat. No. 2,928,638. This pallet features overlying and underlying preformed sheets held in spaced-apart relation by a plurality of hollow pedestals, however, it is usually desired that a pallet be capable of being repeatedly reused and thus should be of sturdy construction and of relatively low mass and capable of receiving forklift fingers from any one of its four sides and in which the load may be lifted off the pallet.

SUMMARY OF THE INVENTION

A central load bearing open-framework is formed by a pair of elongated spaced-apart parallel stringers transversely overlying and secured to respective end portions of a plurality of transverse supports. The frame is bridged by and secured to a thin rigid sheet formed to define a pair of elongated upwardly open channels on opposing sides of the frame with the end edge portions of the sheet adjacent each channel forming an outwardly disposed load bearing surface lying in the plane of the upper limit of the sheet overlying the frame for receiving forklift fingers thereunder. The sheet forming the walls of the channels is transversely apertured in spaced-apart relation for receiving the fingers of a forklift to lift the load and pallet.

The principal object is to provide a durable, lightweight, inexpensive and easily constructed pallet in which the pallet and any load thereon may be picked up by a forklift from any side of the pallet, including the feature of permitting the load to be lifted off the pallet by the forklift.

DESCRIPTION OF THE PREFERRED EMBODIMENT

Figure 1:
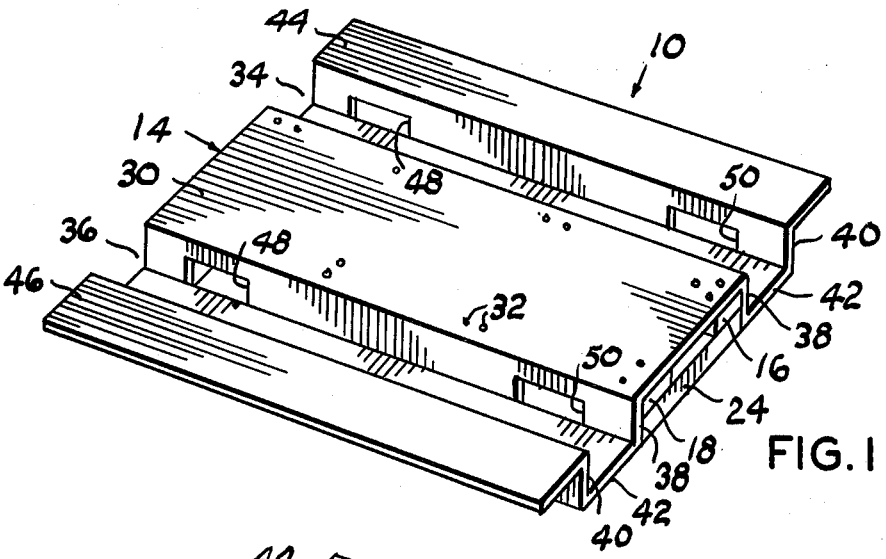
FIG. 1 is a perspective view of the pallet.
Figure 2:
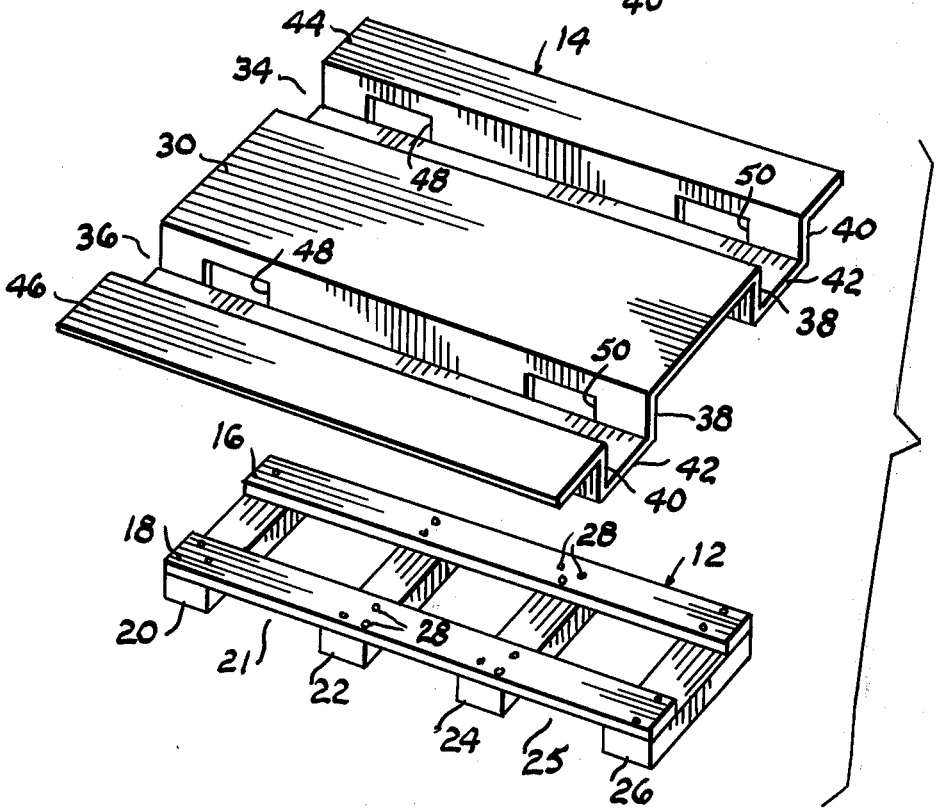
FIG. 2 is a partially exploded perspective view of the components forming the pallet; and, FIG. 3 is a vertical cross sectional view taken substantially along the line 3—3 of FIG. 1 and illustrating the relative position of a forklift finger.

Like characters of reference designate like parts in those figures of the drawings in which they occur.

Figure 3:
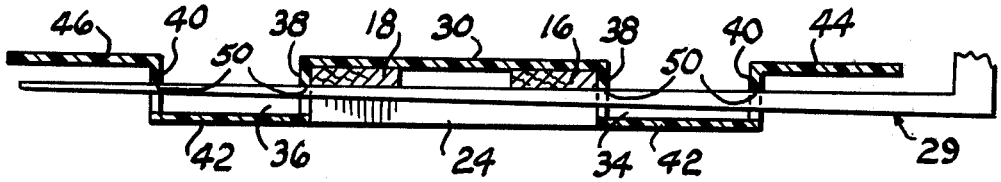

In the drawings:

The reference numeral 10 indicates the pallet, as a whole, comprising a generally flat substantially square unit in overall appearance. The pallet 10 comprises a horizontally disposed central load bearing open-frame 12 and an overlying sheet 14. The frame 12 is formed by a pair of stringers, such as wooden slats 16 and 18 transversely overlying a plurality, four in the example shown, of equally spaced supports 20, 22, 24 and 26 with the stringers 16 and 18 secured thereto, as by nails 28. The spacing 21 between the supports 20–22 and the spacing 25 between the supports 24–26 is at least equal to the transverse width of forklift fingers 29, only one being shown (FIG. 3), for the purpose presently explained.

The sheet 14 is preferably formed from synthetic material, such as plastic, and is relatively thin when compared with the thickness of the stringers 16 and 18 and supports 20–26. The transverse dimension of the sheet 14 is substantially equal to the length of the frame 12 and its central portion, forming a horizontal panel 30, flatly overlies the frame 12 and is secured thereto, as by nails 32 or bonding material. The respective end portions of the sheet, projecting beyond the respective sides of the frame 12, are molded or folded along parallel lines to define a pair of upwardly open channels 34 and 36, each having open ends and a width capable of loosely receiving the fingers 29 of a forklift. Each channel 34 and 36 is defined by parallel vertical side walls 38 and 40 joined by a horizontal bottom wall 42. The channel walls 38 being disposed adjacent the respective sides of the frame 12 and the channel bottoms 42 lying in the plane of the bottom surface of the frame supports 20–26. The respective end edge portions of the sheet form rectangular panels 44 and 46 which project in opposing directions laterally of the respective channels 34 and 36 in the plane of the sheet central panel 30. The transverse width of each end panel is at least as great as the transverse width of forklift fingers 29 for lifting the pallet and any load thereon.

The channel walls 38 and 40 are transversely apertured, intermediate their height, as at 48 and 50, and in alignment with the spacing 21 and 25 between the frame supports 20–22 and 24–26. The purpose of the aligned aperture 48 and 50 is for receiving the forklift fingers 29 for lifting the pallet and the load disposed thereon, not shown.

OPERATION

When the pallet is assembled, as illustrated in FIG. 1, loads to be supported thereby are placed on the upper surface of the sheet 14 when the pallet is lying on a horizontal surface. The fingers 29 of the forklift are spaced to underlie the wings 44 and 46 in a pallet and load lifting action or, alternatively, the forklift fingers may be inserted into the aligned apertures 48 and 50 and the spacings 21 and 25 between the supports. An added feature of the pallet is that, with the forklift fingers adjusted to a closer spaced relation, they may be inserted into the sheet channels 34 and 36, under the load, to lift the load off the pallet thus leaving the pallet in place.

Obviously the invention is susceptible to changes or alterations without defeating its practicability. Therefore, I do not wish to be confined to the preferred embodiment shown in the drawings and described herein.

I claim:

1. A load supporting pallet, comprising:

elongated horizontally disposed frame means including a plurality of supports arranged in parallel spaced relation and a pair of stringers transversely overlying and secured to respective end portions of said supports for defining longitudinal frame sides and a transverse forklift finger receiving open space below the respective end portions of said stringers; and, an elongated sheet having a transverse width coextensive with the length of said frame means and transversely overlying and secured to said frame means for forming a central load supporting panel, the respective end portions of said sheet projecting beyond respective sides of said frame for forming sheet end load supporting panels in the plane of the central panel and receiving forklift fingers thereunder in a pallet lifting action, said sheet being transversely folded along parallel lines between the respective load supporting panels and the frame sides to form an open-ended upwardly open vertical wall horizontal bottom sheet channel adjacent the respective longitudinal frame side for receiving forklift fingers and lifting a load off of a pallet, the vertical walls of said sheet channels having transverse apertures aligned with the transverse open spaces of the frame means for receiving forklift fingers in a pallet lifting action.

* * * * *